US006711367B2

(12) United States Patent
Saito et al.

(10) Patent No.: US 6,711,367 B2
(45) Date of Patent: Mar. 23, 2004

(54) IMAGE FORMING APPARATUS AND BELT UNIT DETACHABLY MOUNTABLE THERETO

(75) Inventors: Seiji Saito, Mishima (JP); Naoki Enomoto, Mishimi (JP); Takashi Shibuya, Shizuoka-ken (JP); Masaru Shimura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/233,514

(22) Filed: Sep. 4, 2002

(65) Prior Publication Data

US 2003/0063921 A1 Apr. 3, 2003

(30) Foreign Application Priority Data

Sep. 4, 2001 (JP) ..... 2001-268084

(51) Int. Cl.[7] ..... G03G 15/00; G03G 15/16
(52) U.S. Cl. ..... 399/121; 399/302; 399/303
(58) Field of Search ..... 399/110, 121, 399/165, 302, 303, 317

(56) References Cited

U.S. PATENT DOCUMENTS 5,809,387 A 9/1998 Takeuchi et al. ..... 399/302
5,943,540 A * 8/1999 Okamoto et al. ..... 399/302

FOREIGN PATENT DOCUMENTS

JP 8-123215 A * 5/1996
JP 2001-166602 A * 6/2001

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes an image bearing member; a belt for transferring an image from the image bearing member onto a recording material; transferring means for transferring the image from the image bearing member toward the belt; wherein the transferring means presses against the image bearing member through the belt; a tension member for applying tension the belt; wherein the belt is extended around the transferring means and the tension member; releasing means for releasing a tension applied to the belt by the tension member; separating means for separating the transferring means from the belt.

11 Claims, 7 Drawing Sheets

IMAGE FORMING APPARATUS AND BELT UNIT DETACHABLY MOUNTABLE THERETO

FIELD OF THE INVENTION AND RELATED ART

The present invention relates to an image forming apparatus such as a copying machine or printer in which a toner image formed on an image hearing member through an electrophotographic type or electrostatic recording type is transferred onto an intermediary transfer member and then is transferred onto a recording material or onto a recording material carried on recording material feeding means, and also relates to a belt unit detachably mountable to such an image forming apparatus.

Heretofore, an intermediary transfer type has been used in which a toner image is formed on a drum type electrophotographic photosensitive member (photosensitive drum) (image bearing member) in an electrophotographic type image forming apparatus, and is temporarily transferred (primary transfer) onto an intermediary transfer member, and thereafter, the toner image is transferred onto a recording material such as a sheet of paper from the intermediary transfer member. In the intermediary transfer type, toners images of different colors are sequentially formed by developing devices on the photosensitive drum. The primary transfer step of transferring the toner image onto the intermediary transfer member is repeated to superimpose the different color images on the intermediary transfer member. Then, the toner image comprising the different color images are all together transferred onto the recording material (secondary transfer) to form a full-color image.

As for the intermediary transfer member, an intermediary transfer belt is known which is which is extended around a plurality of rollers along an endless path.

FIG. 9 substantially shows an example of an intermediary transfer belt used in a conventional image forming apparatus.

The intermediary transfer belt 305 used here is resin film or PVDF (polyvinylidene fluoride). Nylon, PET (polyethylene terephthalate), polybarbonate or the like (resistance adjusting treatment has been made if necessary), having a thickness of 100 200 $\mu$m and a volume resistivity $10^{11}$ $10^{16}$ $\Omega$·cm, formed into an endless belt. The intermediary transfer belt 305 is stretched around a rear surface roller 316, a driving roller 317, a tension roller 318 and so on.

A primary transfer roller 308 functioning as primary transferring means for transferring the toner image onto the intermediary transfer belt 305 from the photosensitive drum 301, is disposed at a position opposed to the photosensitive drum 301 with the intermediary transfer belt 305 is therebetween. The primary transfer roller 308 is supplied with a primary transfer bias during the transfer operation. The primary transfer roller 308 is a low resistance roller having a volume resistivity not more than $10^5$ $\Omega$·cm.

A secondary transfer roller 309 as secondary transferring means for transferring the toner image onto the recording material P from the intermediary transfer belt 305 is disposed at a position opposed to the rear surface roller 316 with the intermediary transfer belt 305 therebetween. The secondary transfer roller 309 is supplied with a secondary transfer bias during the secondary transfer operation.

As described in the foregoing, by using the thin film as the intermediary transfer belt 305, a large electrostatic capacity such as several 100 to several 1000pF can be assured at the primary transfer nip where the primary transfer roller 308 is opposed to the photosensitive drum 301 through the intermediary transfer belt 305.

In the prior art structure, discharging needles 319 (discharging member) are disposed at a position a predetermined distance away from the primary transfer roller 308 and the intermediary transfer belt 305 downstream of the primary transfer roller 308 with respect to the moving direction (rotational direction) of the intermediary transfer belt 305. The discharging needle 319 has the same potential as the main assembly frame of the image forming apparatus, so that abnormality image in the form of polka-dots under the low temperature and low humidity ambience can be prevented. Therefore, the discharging needle 319 is widely used.

In a known structure, the intermediary transfer belt 305, the primary transfer roller 308, the rear surface roller 316, the driving roller 317, the tension roller 318 and the discharging needle 319 are unified into an intermediary transfer unit or cartridge, which is detachably mountable to the main assembly of the image forming apparatus.

In such a cartridge system, the maintenance operation of apparatus can be, in effect, performed by the users, so that operativity can be improved.

On the other hand, in an image forming apparatus of the electrophotographic type, a so-called in-line type image forming apparatus is known in which the image forming apparatus has a plurality of image bearing members. In such an image forming apparatus, the toner images formed on the respective image bearing members by the respective image forming means (image formation station), are sequentially transferred onto a recording material carried on recording material feeding means for carrying the recording material to the respective the image forming stations. Thereafter, the superposed toner images of the different colors are fixed into a full-color image. As for the recording material feeding means, use is made with an electrostatic attraction conveyer belt (conveyer belt) which electrostatically attracts the recording material.

Substantially similarly to the intermediary transfer unit, in a known system, the conveyer belt, the driving roller around which the conveyer belt is stretched, the tension roller, the transferring means (transfer roller) disposed opposed to image bearing member with the conveyer belt therebetween at each of the image forming stations, an intermediary transfer unit (discharging needle) disposed adjacent the conveyer belt and the transfer means, are formed into a unit or cartridge (recording material feeding unit), which is detachably mountable to the main assembly of the image forming apparatus.

However, in the conventional intermediary transfer unit, there are following problems. During the transportation or storage of the intermediary transfer unit after shipping from the plant and before arrival at the dealers, oil or additive materials may transfer to the intermediary transfer belt from the rubber material of the roller or the like contacted to the intermediary transfer belt due to the unavoidable vibrations and so on with the result of chemical reaction with the intermediary transfer belt (chemical attack). In addition, the intermediary transfer belt may suffer from a creep deformation due to tension, permanent strain due to the contact of transfer roller and a damage due to the discharging needle. They are liable to image defect.

The problems with the intermediary transfer unit may arise with the recording material feeding unit, similarly.

SUMMARY OF THE INVENTION

Accordingly, it is a principal object of the present invention to provide an image forming apparatus and a belt unit wherein the creep deformation of the belt, the permanent strain, the chemical attack or the damage of the discharging member can be avoided despite vibrations and so on during the transportation before the start of use.

According to an aspect of the present invention, there is provided an image forming apparatus comprising an image bearing member; a belt for transferring an image from said image bearing member onto a recording material: transferring means for transferring the image from said image bearing member toward said belt, wherein said transferring means presses against said image bearing member through said belt; a tension member for applying tension the belt, wherein said belt is extended around said transferring means and said tension member; releasing means for releasing a tension applied to said belt by said tension member; separating means for separating said transferring means from said belt.

According to another aspect of the present invention, there is provided a belt unit detachably mountable to a main assembly of an image forming apparatus, said unit comprising a belt; transferring means for transferring an image toward said belt; a tension member for applying a tension to said belt, wherein said belt is extended around said transferring means and said tension member, releasing means for releasing a tension applied to said belt by said tension member; separating means for separating said transferring means from said belt.

These and other objects, features and advantages of the present invention will become more apparent upon a consideration of the following description of the preferred embodiments or the present invention taken in conjunction with the accompanying drawings.

PREFERRED EMBODIMENT OF THE PRESENT INVENTION

Referring to the accompanying drawings, the description will be made as to the image forming apparatus, the intermediary transfer unit and the recording material feeding unit according to an embodiment of the present invention.

Embodiment 1

Figure 1:
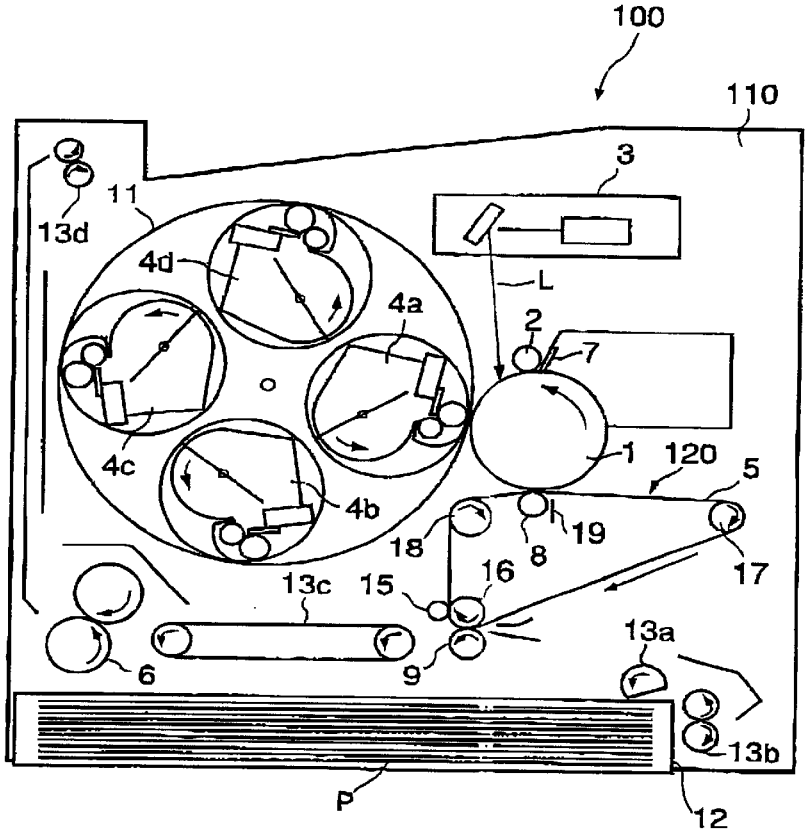
FIG. 1 illustrates an image forming apparatus according to an embodiment of the present invention.

FIG. 1 schematically illustrates an image forming apparatus according to all embodiment or the present invention. In this embodiment, the image forming apparatus 100 is a color image forming apparatus of an electrophotographic type, in which toner images of respective colors formed in accordance with color-separated pieces of image information (yellow, magenta, cyan and black), is transferred (primary transfer) onto an intermediary transfer member, so that they are once superimposed, and then, the toner images are transferred (secondary transfer) onto the recording material. The general arrangement and operation of the image forming apparatus of this embodiment will first be described.

The image forming apparatus 100 comprises an electrophotographic photosensitive member which is a drum type image bearing member (photosensitive drum 1). The photosensitive drum 1 is driven in a direction indicated by an arrow by a driving means (unshown), and is uniformly charged by a primary charger 2 (charging means). Then, a laser beam L of image information corresponding to the yellow color is projected onto the photosensitive drum 1 by an exposure device 3 so that latent image is formed on the photosensitive drum 1.

With a further rotation of the photosensitive drum 1 in the direction of the arrow, a rotatable supporting member 11 rotates so that yellow color developing device 4*a* containing a yellow color developer among yellow color developing device, magenta color developing device, cyan color developing device and black color developing device 4*a*, 4*b*, 4*c*, 4*d*, is opposed to the photosensitive drum 1. By the thus set yellow color developing device 4*a*, the latent image formed on the photosensitive drum 1 in accordance with the image information (yellow color) is visualized into a toner image.

At a position downstream of the development position with respect to the rotational direction of the photosensitive drum 1, there is provided an intermediary transfer belt 5 which travels along an endless path around a plurality of rollers. In this embodiment, the intermediary transfer belt 5 is an endless belt film extended around a rear surface roller 16, a driving roller 17 and a tension roller 18, and is moved ((rotation) in the direction indicated by an arrow substantially at the same speed as the peripheral speed of the photosensitive drum 1.

At a position opposed to the photosensitive drum 1 with the intermediary transfer belt 5 therebetween, a primary transfer roller 8 (primary transferring means) is disposed to form a primary transfer nip. Then, with the rotations of the photosensitive drum 1 and the intermediary transfer belt 5, the toner image is transferred (primary transfer) onto the outer surface of the intermediary transfer belt 5 from the photosensitive drum 1 by application of a primary transfer bias to the primary transfer roller 8. Discharging needles 19 (discharging member) are disposed at a predetermined distance relative to the primary transfer roller 8 and the intermediary transfer belt 5, downstream of the primary transfer roller 8 with respect to the moving direction of the intermediary transfer belt 5.

By repeating the foregoing steps for the magenta color, the cyan color and the black color, toner image of different colors are formed on the intermediary transfer belt 5. For example, in the case of a full-color image, the toner images of the yellow color, the magenta color, the cyan color and the black color are superimposed.

A recording material P is fed at a predetermined timing by a pick-up roller 13*a* and feeding rollers 13*b* from a recording material cassette 12 into a secondary transfer nip where a secondary transfer roller 9 (secondary transferring means) is opposed to the rear surface roller 16 with the intermediary transfer belt 5 therebetween. Simultaneously, a secondary transfer bias is applied to the transfer roller 9, by which the toner image is transferred onto the recording material P from the intermediary transfer belt 5.

Further, the recording material P is fed to a fixing device 6 by a conveyer belt 13*c*. The toner image transferred onto the recording material P by the fixing device 6, is fused and fixed on the recording material P. Thereafter, the recording material P is discharged to the outside of the apparatus by discharging rollers 13*d*. In this manner, a color image is printed.

The developer which remains on the intermediary transfer belt 5 without having been transferred onto the recording material P (untransferred residual toner) is supplied with charge by a cleaning roller 15 (intermediary transfer member cleaning means), and is transferred back to the photosensitive drum 1 in the next primary transfer operation. on the other hand, the developer deposited on the photosensitive drum 1 (untransferred toner) is removed by a cleaning blade 7 (photosensitive member cleaning means).

Figure 2:
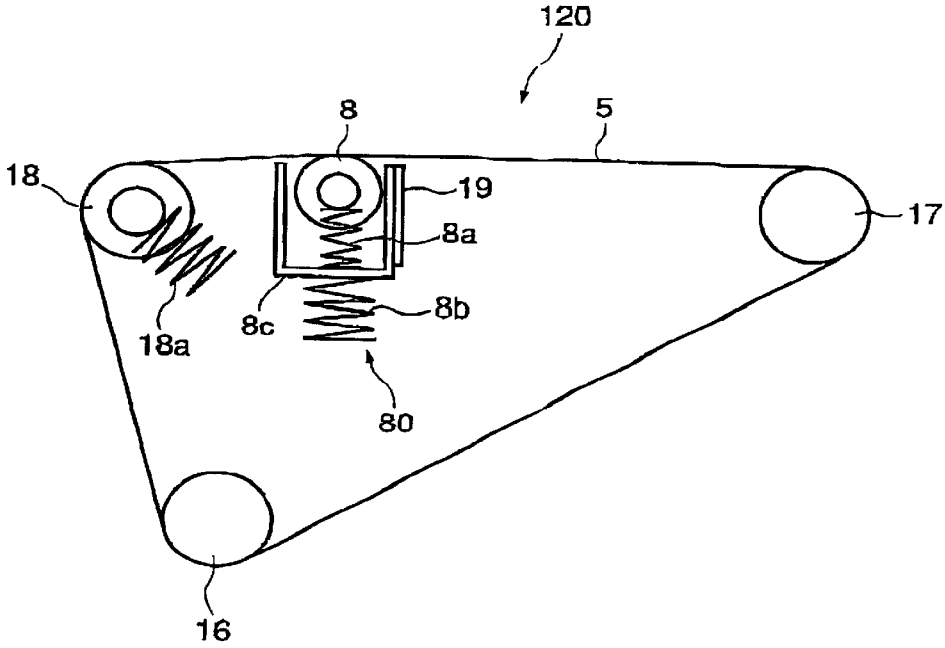
FIG. 2 illustrates an intermediary transfer unit detachably mountable to the main assembly of the apparatus.

Referring to FIG. 2, too, the intermediary transfer unit 120 detachably mountable to the main assembly 110 of the image forming apparatus will be described in detail.

In this embodiment, the intermediary transfer unit 120 which is a belt unit contains the primary transfer roller 8, the rear surface roller 16, the driving roller 17, the tension roller 18 and the discharging member 19 as a unit (cartridge) which is detachably mountable to the main assembly 110 of the image forming apparatus.

In this embodiment, the intermediary transfer belt 5 is an endless film of PVDF (polyvinylidene fluoride) having a thickness of 100 $\mu$m and a volume resistivity of $10^{12}$ Ωcm. The primary transfer roller 8 is a low resistance roller having a volume resistivity of not more than $10^5$ Ωcm. The primary transfer roller 8 is urged toward the photosensitive drum 1 through the intermediary transfer belt 5 by a spring 8*a* at a total pressure of 9.8 N.

The primary transfer roller 8 is contained in a holder 8*c* and is positioned downstream of the primary transfer roller 8 with respect to the moving direction of the intermediary transfer belt 5. A side wall of the holder 8*c* is provided with discharging needles 19 in the form of saw teeth (discharging member) for removing the electric charge of the intermediary transfer belt 5. The discharging needle 19 is grounded to prevent image defect such as polka-dots defects. The holder 8*c* is provided with a spring 8*b* such that primary transfer roller 8 can be disengaged or separated from the intermediary transfer belt 5.

The primary transfer roller 8, the springs 8*a*, 8*b*, the holder 8*c* and the discharging needles 19 constitute a primary transfer roller unit 80. As will be described in detail hereinafter, the primary transfer roller unit 80 is movably or slidably supported on a side plate frame (unshown) of the side plate frame so that primary transfer roller 8, the discharging needle 19 can be made away from the intermediary transfer belt 5.

The driving roller 17 has a rubber layer which is an elastic layer having a small thickness on a surface of a metal roller so as to feed the intermediary transfer belt 5 in order.

The tension roller 18 is a metal roller and maintains a tension of the intermediary transfer belt 5 at a total pressure of 19.6 N.

Figure 3:
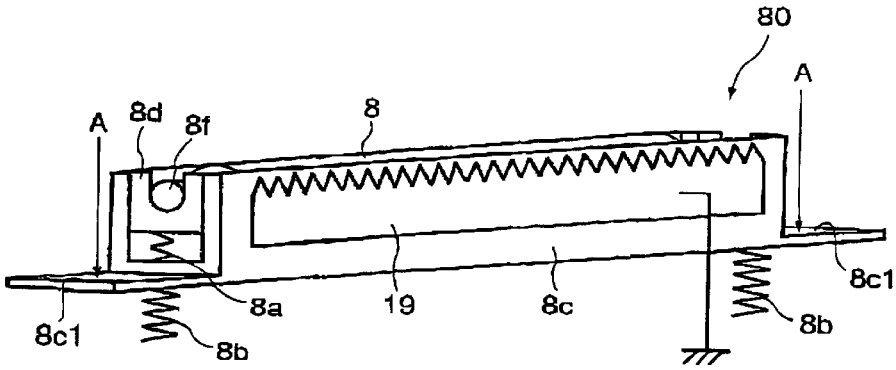
FIG. 3 schematically illustrates a primary transfer roller unit provided in the intermediary transfer unit and a separating operation.

Referring to FIG. 3, too, the primary transfer roller unit 80 will be further described. The transfer roller 8 is supported on the holder 8*c* by supporting the rotation shaft 8*f* extending to a longitudinal end by bearings 8*d*. As described hereinbefore, the bearings 8*d* are urged toward the intermediary transfer belt 5 by a springs 8*a* at the respective longitudinal (in a direction perpendicular to the moving direction of the roller, the longitudinal direction of the primary transfer roller 8) ends such that primary transfer roller 8 is urged to the intermediary transfer belt 5 with a predetermined pressure. Therefore, the bearings 8*d* are retained by stoppers (unshown) so that they are prevented from popping out of the holder c.

At the opposite longitudinal ends of the holder 8*c*, springs 8*b* are mounted to permit the primary transfer roller unit 80 to be away from the intermediary transfer belt 5. By the springs 8*b*, the holder 8*c* is pressed against the side plate frame (unshown) of the intermediary transfer unit 120. At this position, the primary transfer roller 8 is pressed toward the photosensitive drum 1 through the intermediary transfer belt 5 with a predetermined pressure.

Figure 4:
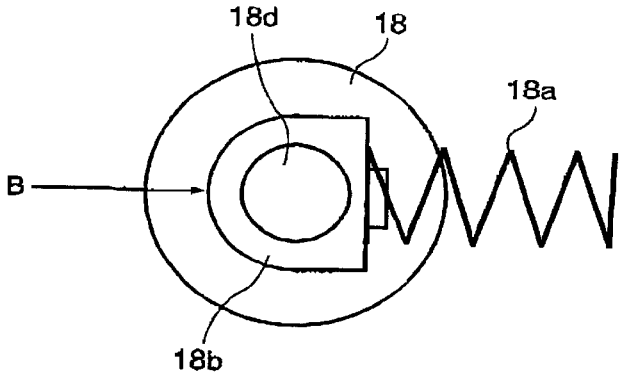
FIG. 4 illustrates an urging force releasing operation of the tension roller provided in the intermediary transfer unit.

A rotational shaft 18*d* or the tension roller 18 extending at the opposite longitudinal ends as shown in FIG. 4, is rotatably supported by the bearings 18*b*. The bearings 18*b* are movably, more particularly, slidably supported on the side plate frame of the holding. The tension roller 18 is urged in the direction of stretching the intermediary transfer belt 5 by the spring 18*a* through the bearing 18*b* to maintain a predetermined tension of the intermediary transfer belt 5.

Figure 5:
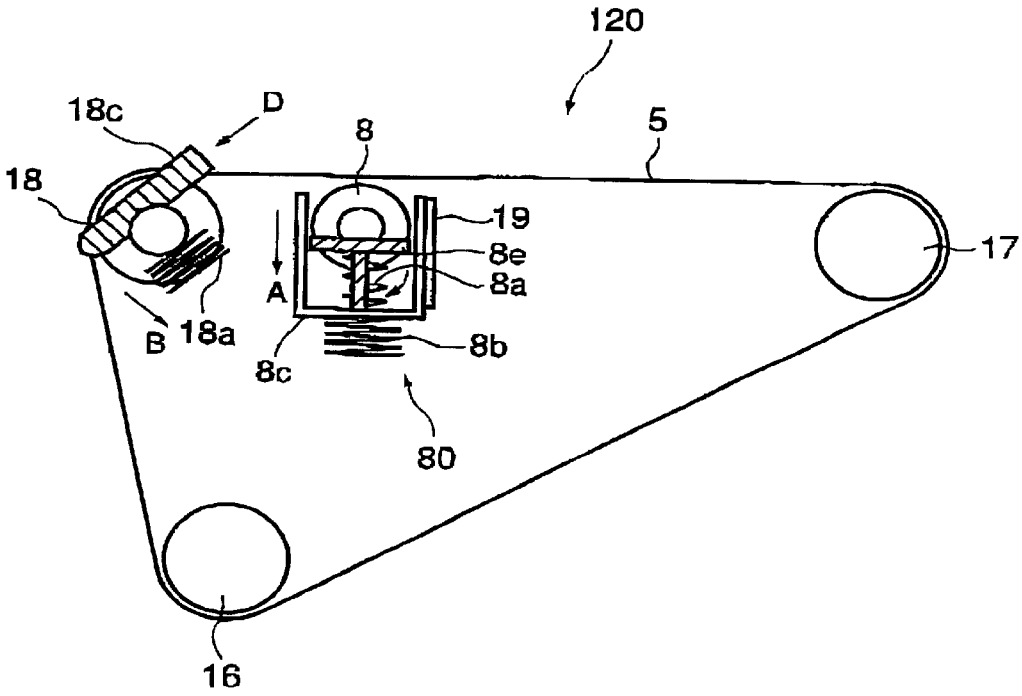
FIG. 5 illustrates easing of the tension of the intermediary transfer belt, and the primary transfer roller is separated from the intermediary transfer belt, in the intermediary transfer unit.

In order to prevent chemical attack due to oozing from the driving roller 17 for the intermediary transfer belt 5, the creep deformation due to the tension and the permanent strata produced by the contact of the primary transfer roller 8, the intermediary transfer unit 120, as shown in FIG. 5, the primary transfer roller 8 is separated away from the intermediary transfer belt 5, or the urging force in the direction of stretching the intermediary transfer belt 5 applied by the tension roller 18 to ease the tension of the intermediary transfer belt 5, upon necessity, that is, upon shipping typically.

First, the opposite end portions of the holder 8*c* supporting the transfer roller 8 is pushed in the direction of an arrow An in the Figure using the primary transfer roller separating lever 8C (transfer member separating means), it is moved away from the intermediary transfer belt 5 together with the primary transfer roller 8 and the discharging needles 19.

Figure 6:
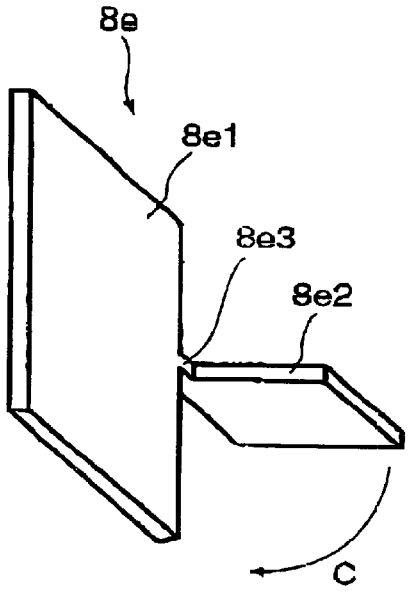
FIG. 6 illustrates a separating member for separating or disengaging the primary transfer roller from the intermediary transfer belt.

In this embodiment, the primary transfer roller separating lever 8C as shown in detail in FIG. 6, is provided with a holding portion 8*e*1, an abutting portion 8C2 and a locking shaft 8G3. The locking shaft 8C3 is engaged with a locking portion provided on the side plate frame of the intermediary transfer unit 120, and the abutting portion 8C2 is rotated by 90° in the direction indicated by an arrow C in the Figure about the locking shaft 8C3 to abut a receiving portion 8*c*1 (FIG. 3) extending at the opposite ends of the holder 8*c*, and the holder 8*c* is pushed in the direction indicated by an arrow A, and the primary transfer roller 8 is maintained at a position remote from the intermediary transfer belt 5 against the urging force of the spring 8*b*. At this time, the primary transfer roller remote lever 8C is at a position of 90° from the inserted position, and in this state, the holding portion 8*el* or the abutting portion 8C2 are fixed by a stopper of the side plate frame of the intermediary transfer unit 120.

As shown in FIG. 5, a tension roller remote lever 18*c* functions as a tension application releasing means, by which the bearings 18*b* of the tension rollers 18 are pushed in the direction indicated by an arrow B, so that tension of the intermediary transfer belt 5 produced by the tension roller 18 is eased.

Figure 7:
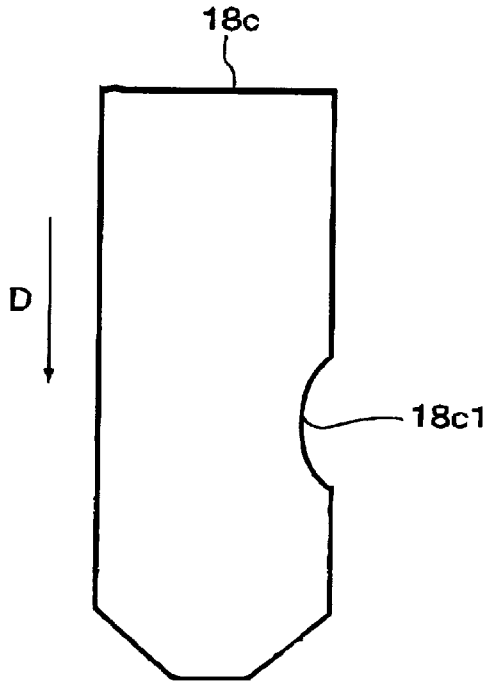
FIG. 7 illustrates a separating member for releasing the urging force of the tension roller.

In this embodiment, as shown in detail in FIG. 7, the tension roller remote lever 18*c* is pushed into a guide extending in a direction perpendicular to the urging force of the spring 18*a* provided on the side plate frame or the intermediary transfer unit 120. More particularly, it is moved in the direction indicated by an arrow D in the Figure so as to push the bearing 18*b* in the direction indicated by arrow B, by which the bearing 18*b* is set in a recess 18*c*1 of the tension roller remote lever 18*c*. By doing so, the tension roller 18 is maintained at a position where the tension of the intermediary transfer belt 5 is eased in the tension against the urging force of the spring 18*a*.

By releasing the pressing of the tension roller 18 and the holder 8*c* of the primary transfer roller 8 using the transfer roller remote lever 8C, the tension roller remote lever 18*c* in the manner described, the tension of the intermediary transfer belt 5 is eased, and the primary transfer roller 8 can be made away from the intermediary transfer belt 5, and the discharging needle 19 can be made away from the intermediary transfer member 5.

In this embodiment, the releasing operation for the holder 8*c* of t primary transfer roller 8 and the tension roller 18 is carried out upon shipping of the intermediary transfer unit 120 from a plant. Therefore, when the intermediary transfer unit 120 is mounted on the main assembly 110 of the image forming apparatus, the user pulls the primary transfer roller remote lever 8C and the tension roller remote lever 18*c* out. By this, the primary transfer roller unit 80 is pressed against the side plate frame of the intermediary transfer unit 120 by the urging force of the spring 8*b*, and the primary transfer roller 8 is pressed toward the photosensitive drum 1 through the intermediary transfer belt 5 by the spring 8*a*. The tension roller 18 now functions to maintain the predetermined tension of the intermediary transfer belt 5 by the urging force of the spring 18*a*.

As described in the foregoing, by easing the tension of the intermediary transfer belt 5, the creep deformation and/or the chemical attack can be prevented and by separating the primary transfer roller 8 from the intermediary transfer belt 5, the production of the permanent strain can be prevented. Thus, the image defect can be avoided. By constituting the unit including the discharging needle 19 disposed adjacent the primary transfer roller 8 together with the primary transfer roller 8, the simultaneous separation of the discharging needle 19 is accomplished upon separation oaf the primary transfer roller from the intermediary transfer belt 5, thus preventing the damage, by the discharging needles 19, of the intermediary transfer belt 5 flexed by the tension easing.

In this embodiment, the description has been made as to the intermediary transfer unit 120 containing as a unit the intermediary transfer belt 5, the rear surface roller 16, the driving roller 17, the tension roller 18, and the primary transfer roller unit 80. However, this invention is applicable to a so-called imaging unit containing as a unit the image bearing member such as a photosensitive drum 1 and the intermediary transfer unit 120, if the pressure releasing structure of the primary transfer roller unit 80 and the tension roller 18 is used. In this case, the chemical attack to the photosensitive drum 1 and so-called drum memory which may be caused by vibration due to transportation or storage during the period from the shipping of the unit from the plant to the user. The drum memory may be caused in this way. The charging particularly properly of the surface or the photosensitive drum 1 locally changes by rubbing or the like, with the result of local density change (local decrease or increase) in the formed image.

Embodiment 2

The description will be made as to the other embodiment. In this embodiment, the present invention is applied to the recording material feeding means in a so-called in-line type image forming apparatus having a plurality of image bearing members. The image forming apparatus comprises image formation stations including a plurality of image forming means, namely, yellow, magenta, cyan and black image formation stations. They form respective toner images on the associated image bearing members through electrophotographic type process, similarly to Embodiment 1.

Figure 8:
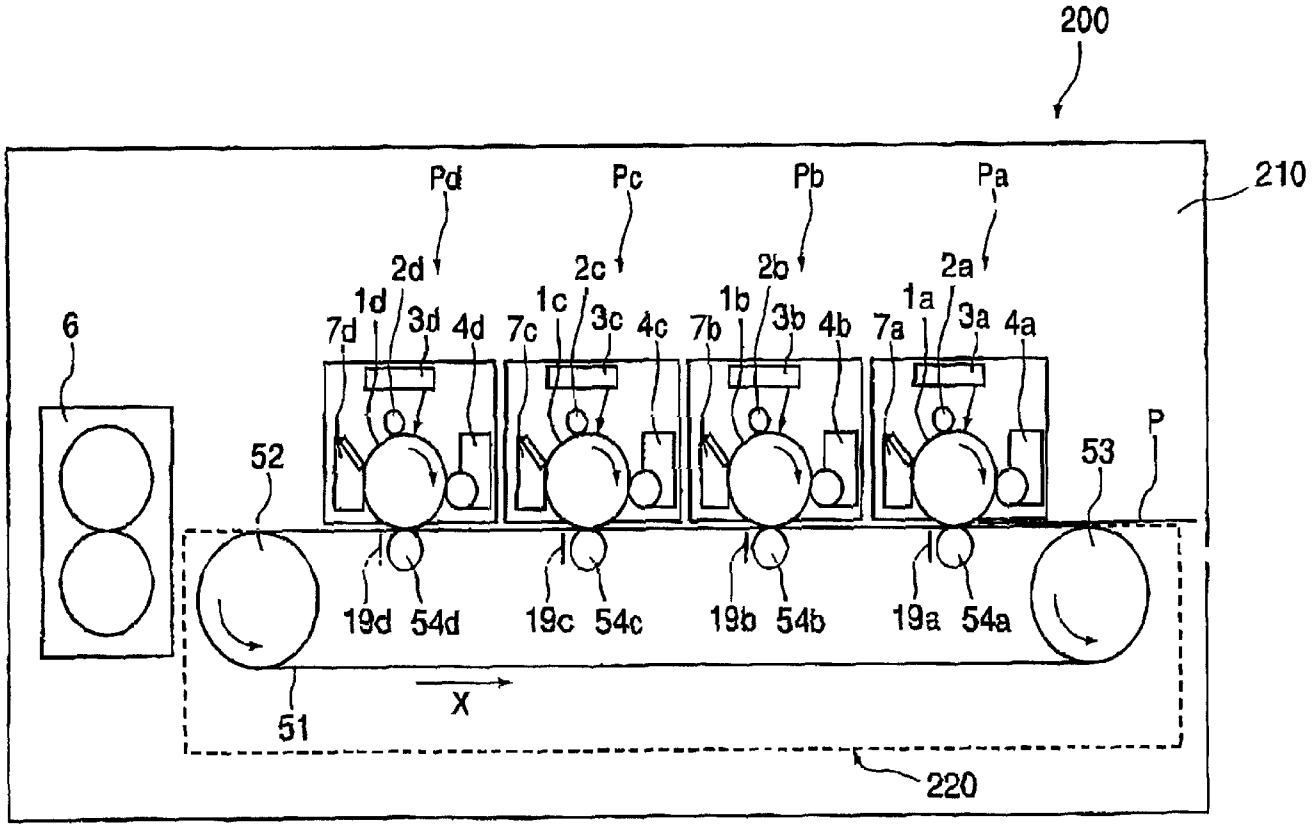
FIG. 8 illustrates an image forming apparatus according to another embodiment of the present invention.
Figure 9:
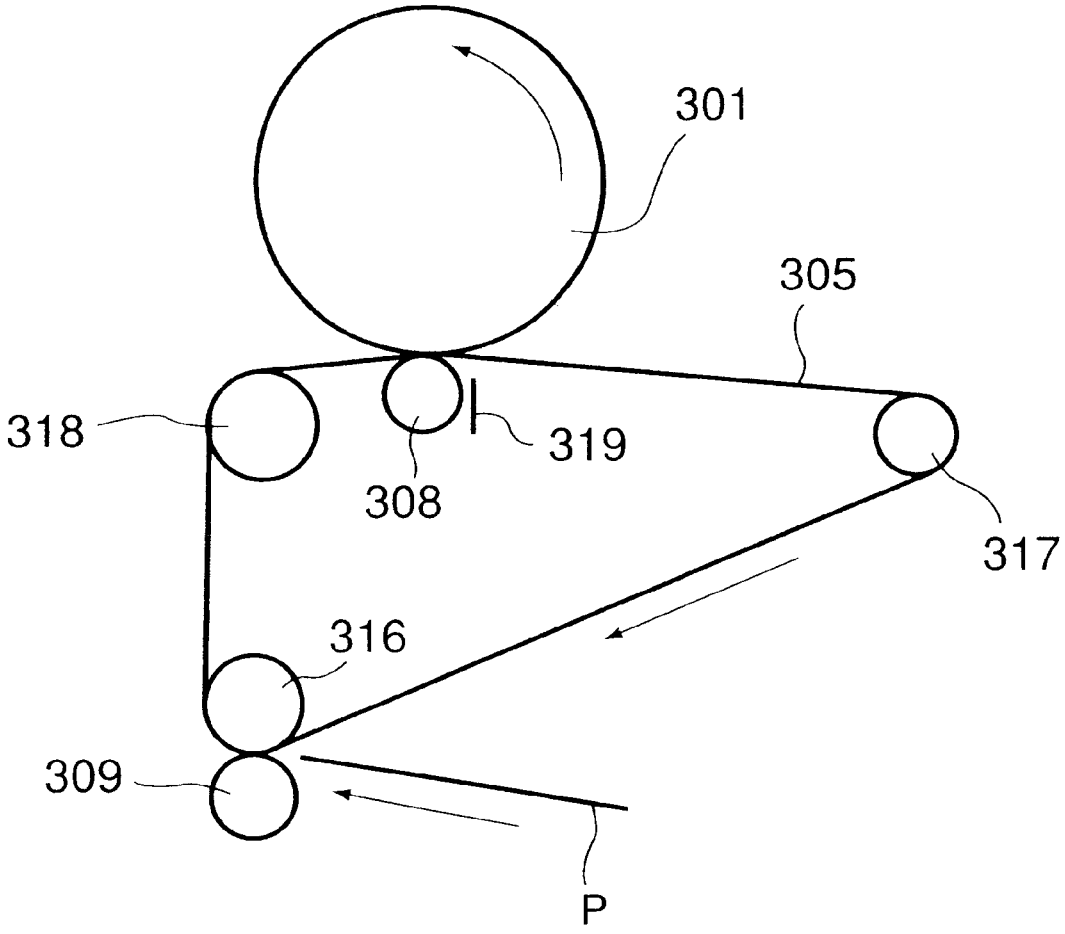
FIG. 9 PRIOR ART
FIG. 9 illustrates a conventional intermediary transfer unit

FIG. 8 shows a schematic structure of a major part of the image forming apparatus 200 of this embodiment. In the image forming apparatus 200, the recording material feeding means is in the form of an electrostatic attraction type conveyer belt (feeding belt) 51 for electrostatically attracting the recording material is extended around a driving roller 52 and a tension roller 53. Along the peripheral surface of the conveyer belt 51, the first, second, third and fourth image forming means (black, magenta, cyan and yellow image formation stations (process station) Pa, Pb, Pc and Pd. The conveyer belt 51 rotates in the direction of an arrow X in the Figure, by which the recording material P is sequentially fed to the image formation stations Pa, Pb, Pc, Pd.

The description will be made as to the operation in the image formation station, taking the first image formation station Pa for example. The first image formation station has an image bearing member in the form of a drum type electrophotographic photosensitive member (photosensitive drum 1*a*) which is rotatable in the direction indicated by an arrow. The surface of the photosensitive drum 1*a* is uniformly charged by primary charging means 2*a*, and then, the exposure means 3*a* projects a laser beam modulated in accordance with image information onto the surface, so that electrostatic latent image is formed on the surface of the photosensitive drum 1*a*. Then, a developer is deposited on the electrostatic latent image by a developing device 4*a* to form a toner image on the photosensitive drum 1*a*.

On the other hand, in timed relation with the formation of the toner image on the photosensitive drum 1*a*, a recording material P fed from a predetermined recording material accommodating portion (unshown) and attracted on a conveyer belt 51 is fed to a transfer nip where the transferring means in the form of a transfer roller 54*a* is opposed to the photosensitive drum 1*a* with the conveyer belt 51 therebetween.

The toner image formed on the photosensitive drum 1*a* is electrostatically transferred onto the recording material P which is attracted and carried on the conveyer belt 51 to the transfer position opposed to the photosensitive drum 1*a*.

The unfixed toner image transferred onto the recording material P is fixed by being heated and pressed in the fixing device 6 into a permanent image.

The developer (untransferred toner) remaining on the photosensitive drum 1*a*–1*d* without having been transferred onto the recording material P, is removed by cleaning means 7*a*–7*d*. and the photosensitive drum 1*a*–1*d* is repeatedly used for image formation. In addition, the conveyer belt 51 is electrically discharged by a discharging charger (unshown) so as to be prepared for the subsequent image forming process.

A discharging member (discharging needles 19*a*, 19*b*, 19*c*, 19*d*) is disposed at a position away from the transfer roller 54*a*–54*c* and the conveyer belt 51 by predetermined distances downstream of each of the transfer rollers 54*a*–54*d*.

In this embodiment, the conveyer belt 51, the driving roller 52, the tension roller 53, each or the transfer rollers 54*a*–54*d* and each or the discharging needles 19*a*–19*d* are formed into a cartridge as a recording material feeding unit

220 (belt unit) which is detachably mountable to the main assembly 210 of the image forming apparatus.

In this embodiment, the conveyer belt 51 is a resin film of tetrafluoroethylene copolymer resin material (PTFE) in which carbon is dispersed to provide a volume resistivity of $10^{11}$ Ωcm, the resin film having a thickness of 100 μm. The transfer rollers 54*a*–54*d* have the similar structures to the primary transfer rollers 8 in Embodiment 1. The driving roller 52, the tension roller 53 and the discharging needle 19*a*–19*d* have the similar structures to those or Embodiment 1.

Similarly to the intermediary transfer unit 120 in Embodiment 1. In the recording material feeding unit 220, because of the vibration and transportation in the period to arrival at the user, there are liabilities of chemical attack by oozing of material from the driving roller 52 for the conveyer belt 51, a creep deformation due to tension, a permanent strain due to the contact of the transfer rollers 54*a*–54*d*.

In this embodiment, in order to prevent them, the transfer rollers 54*a*–54*d* are separated from the conveyer belt 51 using the structures similar to Embodiment 1 upon shipping, and the tension applied to the conveyer belt 51 by the tension roller 53 is eased using the structures similar to Embodiment 1.

In this embodiment, the transfer rollers 54*a*–54*d* are parts of a unit together with the discharging needles 19*a*–19*d*, similarly to t primary transfer roller unit 80 in Embodiment 1. The tension roller 53 maintains a predetermined tension in the conveyer belt 51 by the structure similar to the tension roller 18 for t intermediary transfer belt 5 in Embodiment 1. Therefore, similarly to Embodiment 1, the primary transfer rollers 54*a*–54*d* can be separated from the conveyer belt 51 upon shipping of the recording material feeding unit 220, and simultaneously, the discharging needles 19*a*–19*d* can be placed away from the conveyer belt 51. The urging force in the direction or stretching the conveyer belt 51 applied to the tension roller 53 can be removed, too, similarly to Embodiment 1, by which the tension of the conveyer belt 51 can be released. The description of the separating operation of the transfer rollers 54*a*–54*d* and the discharging needles 19*a*-19*d*, the urging force releasing operation for the tension roller 53, is omitted for simplicity because it is the same as with Embodiment 1.

According to this embodiment, it is possible to prevent the chemical attack to the conveyer belt 51, the creep deformation due to the tension and the production of the permanent strain by contact of the transfer roller 54*a*–54*d*. Moreover, the discharging needles 19*a*–19*d* are simultaneously separated, so that conveyer belt flexed by tension easing is protected from a damage by the discharging needles 19*a*–19*d*.

In this embodiment, the intermediary transfer belt, the conveyer belt are in the forms of an intermediary transfer belt and a recording material feeding unit which are detachably mountable to the main assembly of the image forming apparatus (cartridge). The present invention is applicable to the cases where the intermediary transfer belt and/or the conveyer belt is fixed in the image forming apparatus. Even in such a case, the chemical attack, the creep deformation, the permanent strain and the damage by the discharging member, can be effectively prevented, from which the intermediary transfer belt or the conveyer belt suffer due to the vibration or transportation in the period from the shipment of the image forming apparatus to the arrival at the user.

According to the present invention, by easing the tension of the intermediary transfer member, the recording material feeding means, the creep deformation or the chemical attack can be prevented, and by separating the transferring means from the intermediary transfer member and the recording material feeding means, the production of the permanent strain can be prevented. By unifying the discharging member disposed adjacent to the transferring means with the transferring means (unit structure), the discharging member can be separated by separating the transferring means from the intermediary transfer member and the recording material feeding means, so that damage to the intermediary transfer member and to the recording material feeding means can be prevented. Thus, according to the present invention, by easing the tension of the intermediary transfer member, the recording material feeding means, the creep deformation or the chemical attack can be prevented, and by separating the transferring means from the intermediary transfer member and the recording material feeding means, the production of the permanent strain can be prevented, and therefore, the image defects due to these factors can be prevented.

While the invention has been described with reference to the structures disclosed herein it is not confined to the details set forth and this application is intended to cover such modifications or changes as may come within the purpose of the improvements or the scope of the following claims.

What is claimed is:

1. An image forming apparatus comprising:

an image bearing member;

a belt for transferring an image from said image bearing member onto a recording material;

transferring means for transferring the image from said image bearing member toward said belt, wherein said transferring means presses against said image bearing member through said belt;

a tension member for applying tension to said belt, wherein said belt is extended around said transferring means and said tension member;

releasing means for releasing the tension applied to said belt by said tension member; and separating means for separating all of said transferring means from said belt.

2. An apparatus according to claim 1, further comprising a discharging member provided in said transferring means, said discharging member being separated from said belt together with said transferring means by said separating means.

3. An apparatus according to claim 1, further comprising a driving roller having a surface elastic layer for driving said belt, said belt is extended around said driving roller.

4. An apparatus according to claim 1, wherein said transferring means, said belt, and said tension member are constituted as an integral unit, which is detachably mountable to a main assembly of said apparatus.

5. An apparatus according to claim 1, wherein said belt is an intermediary transfer belt for temporarily carrying an image between said image bearing member and the recording material.

6. An apparatus according to claim 1, wherein said belt is a recording material conveyer belt for carrying the recording material, and wherein the image on said image bearing member is transferred onto a recording material carried on said recording material conveyer belt.

7. A belt unit detachably mountable to a main assembly of an image forming apparatus, said unit comprising:

a belt;

transferring means for transferring an image toward said belt;

a tension member for applying tension to said belt, wherein said belt is extended around said transferring means and said tension member, releasing means for releasing the tension applied to said belt by said tension member; and separating means for separating all of said transferring means from said belt.

8. An apparatus according to claim 7, further comprising a discharging member provided in said transferring means, said discharging member being separated from said belt together with said transferring means by said releasing means.

9. An apparatus according to claim 7, further comprising a driving roller having a surface elastic layer for driving said belt, said belt is extended around said driving roller.

10. An apparatus according to claim 7, wherein said belt is an intermediary transfer belt.

11. An apparatus according to claim 7, wherein said belt is a recording material conveyer belt for carrying a recording material.

* * * * *

UNITED STATES PATENT AND TRADEMARK OFFICE

CERTIFICATE OF CORRECTION

PATENT NO. : 6,711,367 B2
DATED : March 23, 2004
INVENTOR(S) : Seiji Saito et al.

It is certified that error appears in the above-identified patent and that said Letters Patent is hereby corrected as shown below:

Title page,
Item [75], Inventors, "Naoki Enomoto, Mishimi (JP);" should read -- Naoki Enomoto, Mishima, (JP); --.
Item [57], ABSTRACT,
Line 7, "tension" should read -- tension to --.

Column 1,
Line 10, "hearing" should read -- bearing --;
Line 35, "which is" (second occurrence) should be deleted;
Line 41, "floride)." should read -- fluoride), --;
Line 44, "100 200 $\mu$m" should read -- 100-200 $\mu$m --;
Line 45, "$10^{11}$ $10^{16}$ Ω·cm" should read -- $10^{11}$-$10^{16}$ Ω·cm --; and
Line 53, "is" should be deleted.

Column 2,
Line 35, "the" (second occurrence) should be deleted.

Column 3,
Line 15, "tension" should read -- tension to --; and
Line 60, "unit" should read -- unit. --.

Column 4,
Line 3, "all embodiment or" should read -- an embodiment of --;
Line 8, "is" should read -- are --; and
Line 42, "((rotation)" should read -- (rotation) --.

Column 5,
Line 19, "on" should read -- On --; and
Line 47, "polka-dots" should read -- polka-dot --.

Column 6,
Line 3, "springs" should read -- spring --;
Line 38, "is" should read -- are --;
Line 40, "it is" should read -- and are --; and
Line 57, "8*el*" should read -- 8e1 --.

Column 7,
Line 19, "t" should read -- the --; and
Line 42, "oaf" should read -- of --.

UNITED STATES PATENT AND TRADEMARK OFFICE

CERTIFICATE OF CORRECTION

PATENT NO. : 6,711,367 B2
DATED : March 23, 2004
INVENTOR(S) : Seiji Saito et al.

It is certified that error appears in the above-identified patent and that said Letters Patent is hereby corrected as shown below:

Column 8,
Line 14, “material” should read -- material and --; and
Lines 65 and 66, “or” should read -- of --.

Column 9,
Line 6, “Ωcm,” should read -- Ω·cm, --;
Line 9, “needle” should read -- needles --;
Line 10, “or” should read -- of --;
Line 13, “1. In” should read -- 1, in --; and
Lines 27 and 30, “t” should read -- the --.

Signed and Sealed this

Twenty-seventh Day of July, 2004

JON W. DUDAS
*Acting Director of the United States Patent and Trademark Office*